United States Patent [19]

Dimier et al.

[11] Patent Number: 4,688,822

[45] Date of Patent: Aug. 25, 1987

[54] SAFETY SKI BINDING

[75] Inventors: Jean-Pierre Dimier, Rumilly; Joel Bourdeau, Saint-Jorioz, both of France

[73] Assignee: Salomon S.A., Annecy, France

[21] Appl. No.: 683,685

[22] Filed: Dec. 19, 1984

[30] Foreign Application Priority Data

Dec. 20, 1983 [FR] France ..... 83 20355

[51] Int. Cl.[4] ..... A63C 9/081

[52] U.S. Cl. ..... 280/628; 280/629; 280/633; 280/636

[58] Field of Search ..... 280/626, 628, 629, 625, 280/633, 634, 636

[56] References Cited

U.S. PATENT DOCUMENTS

| | | | |
|---|---|---|---|
| 3,000,644 | 9/1961 | Beyl | 280/629' |
| 3,194,574 | 7/1965 | Beyl | 280/625 |
| 3,638,959 | 2/1972 | Reuge | 280/625 |
| 3,942,809 | 3/1976 | Sittmann | 280/618 |
| 4,170,372 | 10/1979 | Salomon | 280/628 |
| 4,260,175 | 4/1981 | Salomon . | |
| 4,337,965 | 7/1982 | Salomon . | |
| 4,345,776 | 8/1982 | Salomon | 280/629 |
| 4,401,318 | 8/1983 | Beyl | 280/625 |
| 4,405,153 | 9/1983 | Salomon . | |

FOREIGN PATENT DOCUMENTS

| | | |
|---|---|---|
| 0030175 | 11/1980 | European Pat. Off. . |
| 0025747 | 3/1981 | European Pat. Off. . |
| 2905837 | 8/1980 | Fed. Rep. of Germany . |
| 1363895 | 5/1964 | France . |
| 2248680 | 5/1975 | France . |
| 2258876 | 8/1975 | France . |
| 2419737 | 10/1979 | France . |
| 2420359 | 10/1979 | France . |
| 2458299 | 1/1981 | France . |
| 2463629 | 2/1981 | France . |
| 2478476 | 9/1981 | France . |
| 2517214 | 6/1983 | France . |
| 2523857 | 9/1983 | France . |

*Primary Examiner*—John J. Love
*Assistant Examiner*—Karin L. Ferriter
*Attorney, Agent, or Firm*—Sandler & Greenblum

[57] ABSTRACT

A ski binding adapted to releasably hold the front of a ski boot on a ski. The front of the boot includes front-end zone spaced from the lateral edges of the boot. The binding includes a jaw, a support, and a support zone on the jaw. The jaw is adapted to hold the front of the boot and adapted to laterally pivot in response to pivoting of the boot. The support, which is positioned on the ski, includes two upwardly converging lines of support. The jaw is adapted to laterally pivot around either one of these upwardly converging jaw lines of support. The support zone which is positioned on the jaw supports the front-end zone of the boot when the boot is held by the jaw. As a result, when the boot experiences a torsional force and a frontward force on the boot, the boot laterally pivots and the front of the boot is pressed downward against the ski and against the support zone means. Friction is generated by the pressing of the sole of the boot on the ski which would normally increase the resistance of the boot to lateral pivoting. However, the pressure of the front of the boot on the support zone means increases the torque of the boot in the direction in which the boot is already pivoting due to the torsional force, to compensate for the friction of the sole of the boot on the ski.

38 Claims, 9 Drawing Figures

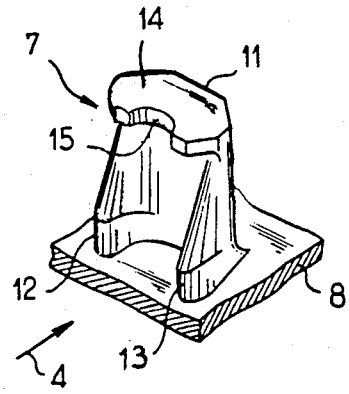
FIG. 5.
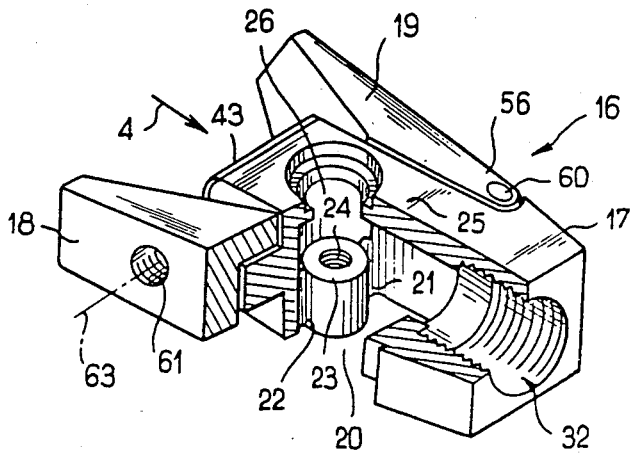
FIG. 6.
FIG. 7.
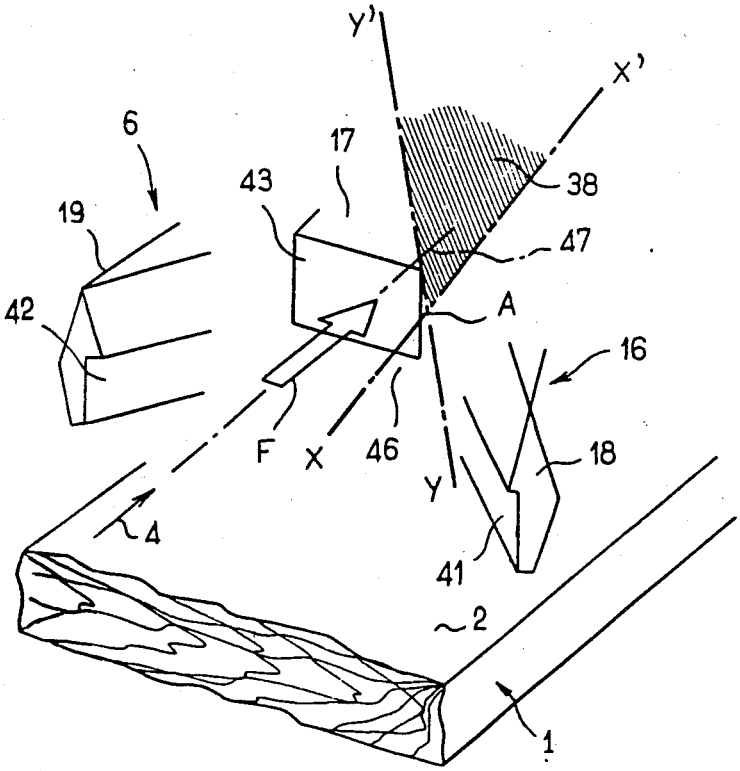

SAFETY SKI BINDING

BACKGROUND OF THE INVENTION

1. Field of the Invention

The present invention relates to a ski binding, as well as to a ski provided with such a binding.

2. Description of Relevant Information

French Pat. Nos. 2,517,214; 2,478,476; 2,458,299; 2,419,737; and 2,420,359 all relate to "front abutment" type bindings.

This type of binding comprises:

a jaw adapted to receive and retain the front end of a ski boot with respect to a ski. Two lateral wings are provided for this purpose at the rear of jaw. The wings are adapted to grip the boot on both lateral sides thereof;

a support element defining, for the jaw, two frontwardly directed lines of support with respect to the ski, for guiding the lateral pivoting of the jaw. The two lines of support converge upwardly at a point, to define a common plane transverse with respect to the ski, such that lateral pivoting of the jaw with respect to the ski around either one of the lines of support is accompanied by a lifting of the wings of the jaw with respect to the ski; and an elastic energization mechanism which presses the jaw against the support element and biases the jaw elastically against lateral pivoting around the lines of support.

In the above-mentioned patents, and in the description of the binding which will follow, absent any specific mention to the contrary, the relative positions of the various elements of the ski binding and the ski are understood to be relative to the direction of the normal displacement of these elements.

These types of bindings are adapted to retain the front end of the boot on the ski, while the rear end of the boot is retained on the ski by other means. This front abutment is adapted to free the boot when the release threshold of the elastic system is reached, for example, in response to excessive torsional forces on the leg. An appropriate adjustment system is also provided for the elastic energization mechanism which permits adjustment of this release threshold of the elastic mechanism.

Such a simple system responds in a entirely satisfactory fashion to a torsional fall which induces torsional movement of the boot. In such an instance, lateral pivoting of the jaw frees the boot due to lateral pivoting of the retention wings. In addition, lateral pivoting of the jaw can also be accompanied by a frontward movement of the jaw with respect to the support element, against the resistance of the elastic energization.

However, it has been discovered that such a binding is inadequate when a torsional fall is combined with a frontward fall. During a frontward fall, that portion of the sole which is directly beneath the front of the foot is pressed downwardly against the ski with a substantial force, thereby creating an appreciable friction between the sole of the boot and the ski which opposes lateral pivoting of the boot and its liberation from the jaw.

As a result, the binds described above must include a supplementary apparatus to compensate for this increased friction during a frontward and torsional fall.

For example, it has been proposed to attach a plate composed of materials having a low coefficient of friction to the upper surface of the ski. Such plates can be made, for example, of polytetrafluorethylene or polyethylene, but this type of arrangement has not been entirely satisfactory. Thus, manufacturers have attempted to find other solutions to this problem.

Another solution that has been proposed is to place a sensor beneath the front of the boot. This sensor acts on the elastic energization mechanism so as to reduce the bias against lateral pivoting produced by that elastic mechanism and is described in German Offenlegungschrift No. 2,905,837. This sensor comprises a pedal which compensates for the friction of the sole of the boot on the ski in response to pressure on the pedal by the boot during a forward fall. This is accomplished by reducing the bias of the elastic energization mechanism. Another type of binding which attempts to solve this problem is described in French Pat. No. 2,523,857, in which a moveable sensor acts on the elastic energization means.

In both of these arrangements, as well as in many other which are known to those skilled in the art, a moveable sensor acts on the elastic energization mechanism to reduce the "hardness" or bias against lateral pivoting of the jaw. These solutions have the disadvantage of requiring a relatively complex structure having numerous elements. Such a complex structure increases the cost of these bindings and increases the risk of malfunction due to freezing conditions in which they are used, due to mud which may be encountered during skiing, or as a the result of the breaking of one of the elements.

There is, therefore, a need for a binding which compensates for this additional friction resulting from an forward fall which does not increase the complexity or reduce the reliability of the binding.

SUMMARY OF THE INVENTION

It is, therefore, an object of the present invention to provide a safety binding of the type discussed above, which is adapted to free the boot during a torsional and forward fall, as well as to free the boot during a torsional fall alone and which does not increase the complexity or reduce the reliability of the binding.

The binding which accomplishes this objective is adapted to releasably hold the front of the ski boot on a ski. The front of the boot can comprise a front end zone, spaced from the lateral edges of the boot. The binding comprises a jaw, a support, and a support zone means on the jaw. The jaw is adapted to hold the front of the boot, is adapted to laterally pivot in response to pivoting of the boot. The support is positioned upon the ski and comprises two upwardly converging lines of support. The jaw is adapted to laterally pivot around either one of these two upwardly converging lines of support. The support zone means is positioned on the jaw and supports the front end zone of the boot when the boot is held by the jaw. The boot has two lateral sides and the jaw further comprises a rear portion and two lateral wings, each lateral wing being adapted to grip one of the lateral sides of the boot. The wings can be positioned at the rear portion of the jaw. Also, the invention can comprise such a binding in combination with a ski.

The support zone means is positioned at the rear portion of the jaw between the two lateral wings, and the support zone means is integral with the jaw.

The binding also comprises an elastic energization mechanism, adapted to press the jaw rearwardly against the support. The elastic energization mechanism biases the jaw against lateral pivoting.

The support also comprises a rear portion. The two upwardly converging lines of support are positioned on the rear portion of the support. Furthermore, the jaw and support together comprise means for lifting the jaw when the jaw laterally pivots around either one of the two upwardly convering lines of support.

The upwardly convering lines of support define a common transverse plane with respect to the ski. The upwardly converging lines of support also converge at a convergence point above the ski. Furthermore, the support zone means comprises means for supporting the front end zone of the boot along a line wich intersects the transverse plane between support lines and above this convergence point.

The jaw can experience a moment in response to lateral pressure from the boot against one of the lateral wings. In such an instance, the support zone means further comprises means for increasing this moment experienced by the jaw, in response to forward pressure of the front end zone of the boot on the support zone means.

In an alternative embodiment, the median level of the support zone means is positioned higher than the convergence point of the two upwardly converging lines of support. In still another embodiment, the median level of the support zone means is positioned at the same vertical level or below the vertical level of the convergence point of the two lines of support. In these embodiments, the support zone means is inclined in the rearward direction.

The sole of the boot can comprise a front portion, and an intermediate portion adjacent to this front portion. In this embodiment, the binding further comprises a sole support positioned under the sole and on the ski. This sole support comprises means for supporting the intermediate portion and for raising the front portion of the sole above the ski. The means for supporting the intermediate portion and raising the front portion of the sole comprises a convex zone positioned under the intermediate portion of the sole and a substantially flat zone positioned under the front portion of the sole. In one embodiment, the sole support is integral with the ski and with the support.

In still another embodiment the jaw further comprises a cut-out portion or recess below the support zone means for receiving the front portion of the sole. In this embodiment, the substantially flat zone is positioned under the cut-out portion and the sole support is positioned beneath the lateral wings of the jaw.

In still another embodiment, the support zone means is positioned at the same vertical level as the upper of the boot. Alternatively, the support zone means can be positioned at the level of the sole of the boot.

In one embodiment, the two upwardly converging lines of support are positioned symmetrically with the respect to one another and with respect to the longitudinal plane of symmetry of the ski when the binding is in its rest position. Furthermore, the support zone means is symmetrical with respect to the plane of symmetry of the ski when the binding is in its rest position, in which the longitudinal axis of the jaw is substantially parallel to the plane of symmetry of the ski. In addition, the binding can be symmetrical with respect to the plane of symmetry of the ski when the jaw is supported by both lines of support simultaneously.

In still another embodiment, the jaw further comprises means for adjusting the relative positions of the lateral wings and the support zone means. In this embodiment that adjusting means can comprise means for rotating each lateral wing around a separate axis which is substantially parallel to the axis around which the jaw laterally pivots. In this embodiment, the separate axes are positioned symmetrically with respect to the longitudinal planes of symmetry of the ski.

The rotating means can comprise a cap, a cramp, and a journal pin. The cap is positioned toward the front of each lateral wing of the jaw and comprises two spaced-apart elements. The cramp is positioned in the space between the two spaced-apart elements, and the journal pin connects the two spaced-apart elements and the cramp. Each lateral wing is adapted to rotate around an axis defined by the journal pin.

The jaw in this embodiment also comprises an opening therein for receiving the support. The jaw further comprises two shoulders, one on each wing, which are adapted to contact a portion of the boot when the boot is held by the jaw. The jaw also includes a cut-out portion for receiving the sole of the boot. In this embodiment, the rotating means further comprises a first opening in each of the wings, and a pin. The longitudinal axis of this first opening is perpendicular to the plane of symmetry of the ski, and the first opening is positioned above the shoulders and the cut-out portion of the jaw. Furthermore, the first opening is positioned rearward of the opening for the support. The pin engages the first opening, and rotation of the pin rotates the lateral wings around the journal pin. The pin can comprise two end portions. In this embodiment, the rotating means further comprises a second opening in each of the lateral wings connected to the first opening. This second opening is positioned between the exterior of each wing and the first opening. Each second opening is adapted to receive a different end portion of the pin. The longitudinal axes of the first openings in each lateral wing are aligned with each other and the second opening comprises a tapped bore. Each end portion of the pin also comprises a tapped portion complementary to the tapped bore of the second opening, whereby each end portion of the pin is adapted to screwed into each second opening.

The jaw further comprises a body, between the lateral wings. This body comprises a transverse slit therein, which extends forward and behind the longitudinal axis of the first opening. The slit opens toward the support zone means. The slit also comprises a recess extending through and symmetrical with the longitudinal axis of the ski. In addition, the pin further comprises a peripheral groove adapted to engage the recess of the slit. Also, one end portion of the pin further comprises a slit adapted to receive a screwdriver for rotating the pin in the first and second openings. Also provided is a means for preventing spontaneous rotation of the pin in the first and second openings.

The support can also comprise: a base attached to the ski; two upwardly converging projections extending above the base and which comprise the two upwardly converging lines of support; a front portion; and a wing positioned on top of the projections and having a recess therein which is symmetrical with respect to the longitudinal plane of symmetry of the ski.

The jaw can further comprise an opening which opens downwardly and in which the support is received. In this embodiment, the jaw forms a cap on top of the support. In addition, the jaw and support can be monoblocks. Also, the jaw can further comprise two grooves in the opening of the jaw which are adapted to receive the projections of the support therein. In a rest position of the jaw, each projection simultaneously contacts one of the grooves of the jaw.

The jaw can further comprise a screw and a projection in the bottom portion of the opening of the jaw. This projection is positioned between the two grooves and, further, comprises a substantially vertical tapped opening therein adapted to receive the screw, whereby the vertical height of the jaw with respect to the support is varied in response to the screwing of the screw in the projection of the jaw.

The jaw also comprises an upper wall, spaced above the projection of the jaw a greater distance than the vertical height of the wing of the support. This upper wall has an opening therein for receiving the screw. The projection of the jaw is of sufficient dimensions such that the wing of the support is positioned between the projections of the jaw and the upper wall when the projections of the support contact the grooves of the jaw.

The screw can comprise a groove therein, positioned between the upper wall and the projection of the jaw when the screw is completely screwed into the opening of the projection of the jaw. In addition, this groove of the screw engages the recess of the wing of the support when the screw is completely screwed into the opening of the projection of the jaw, whereby the screw is frontwardly and laterally supported.

The jaw can further comprise a tapped opening having a longitudinal axis aligned with the longitudinal axis of the ski when the binding is in a rest position. One end of the tapped opening opens into the opening in the jaw. The other end of the tapped opening opens to the exterior of the jaw at the front thereof. In addition, the tapped opening is adapted to receive the elastic energization mechanism.

The elastic energization mechanism, in turn, comprises a compression spring, an adjusting cap, and a piston. The adjusting cap is positioned at the front end of the tapped opening and the compression spring, and is adapted to be screwed into the tapped opening to adjust the tension of the compression spring. The piston is positioned at the rear end of the compression spring and comprises a rear surface, biased against the front surface of the support, whereby the grooves of the jaw are biased against the projections of the support, and the groove of the screw is biased against the recess of the wing of the support.

In addition, the binding can further comprise means for ensuring the front end zone of the boot contacts the support zone means whenever the jaw holds the front of the boot. Furthermore, this ensuring means comprises a recess on the rear portion of the jaw for engaging the sole of the boot when the jaw holds the boot.

In addition, that portion of the jaw behind a plane formed by the lines ofthe support lifts upwardly in response to the lateral pivoting of the jaw around one of the lines of support, and that portion of the jaw in front of the plane formed by the lines of support is displaced downwardly in response to lateral pivoting of the jaw around one of the lines of support. The jaw is configured such that the front portion of the jaw is spaced above the ski when the jaw is in the rest position, to permit downward pivoting of this portion when the jaw pivots around one of the two upwardly converging lines of support.

In still another embodiment, the invention comprises a ski binding adapted to releasably hold the front of a ski boot onto a ski. The front of the boot comprises a front end zone spaced from the lateral sides of the boot. The binding comprises a jaw, a support, and a means for increasing the moment experienced by the jaw in response to the boot experiencing a forward force. The jaw is adapted to hold the front of the boot and is adapted to laterally pivot in response to lateral pivoting of the boot. The jaw experiences a moment in response to lateral pressure from the boot against the jaw. The support is positioned on the ski and comprises two upwardly converging lines of support. The jaw is adapted to laterally pivot around either one of these two upwardly converging lines of support.

The increasing means increases the moment in response to a frontward fall.

In addition, the invention can comprise the binding in combination with the ski. Furthermore, the jaw can further comprise a rear portion and two lateral wings, each lateral wing being adapted to grip one of the lateral sides of the boot. The wings are positioned at the rear portion of the jaw. In addition, the increasing means is positioned at the rear portion of the jaw and between the two lateral wings and is integral with the two wings.

The binding can further comprise an elastic energization mechanism adapted to press the jaw rearwardly against the support. This elastic energization mechanism biases the jaw against lateral pivoting.

This support further comprises a rear portion. The two upwardly converging lines of support are positioned on this rear portion, and the jaw and support together comprise means for lifting the jaw when the jaw laterally pivots around either one of the upwardly converging lines of support.

The upwardly converging lines of support define a common transverse plane with respect to the ski. Furthermore, the upwardly converging lines of support converge at a convergence point. In addition, the increasing means comprises means for supporting the front end zone of the boot along the line which intersects this transverse plane between the support lines and above the convergence point.

In one embodiment, the means is positioned higher than the convergence point.

Furthermore, the boot can further comprise a sole having a front end and a front end zone spaced from the lateral sides of the boot. In this embodiment, each lateral wing comprises a recess adapted to receive the front end of the sole therein.

In another embodiment, the boot can further comprise an upper having a front end zone. In this embodiment, the increasing means is positioned higher than the recesses and the increasing means comprises means for frontwardly supporting the front end zone of the upper.

The jaw can further comprise means for adjusting the relative positions of the lateral wings and the support zone means. In addition, the support lines can be positioned symmetrically with respect to one another and with respect to the longitudinal plane of symmetry of the ski. In addition, the increasing means is symmetrical with respect to the plane of symmetry of the ski when the biasing is in a rest position in which the longitudinal axis of the jaw is substantially parallel to the plane of symmetry of the ski. In addition, the two lines of support can contact the jaw when the binding is in the rest position, and the binding is symmetrical with respect to the plane of symmetry of the ski when the jaw is supported by both lines of support simultaneously.

BRIEF DESCRIPTION OF THE DRAWINGS

Additional characteristics and advantages of the present invention will become clear from the detailed description which follows, as well as the attached drawings, in which:

FIG. 4 also illustrates the position of the boot during a frontward fall;

FIG. 5 illustrates a partially broken away perspective view along arrow V of FIG. 1, of a portion of the support in which the two upwardly converging lines of support around which the jaw laterally pivots can be seen;

FIG. 6 illustrates a partially broken away perspective view of the jaw taken along arrow V in FIG. 1, wherein grooves can be seen in the jaw which are adapted to receive the upwardly converging projections on the supports;

FIG. 7 is a schematic perspective view of the binding taken in the same direction as FIG. 5, and shows the effect of the force applied fronwardly on the jaw of the binding;

DETAILED DESCRIPTION OF PREFERRED EMBODIMENTS

Figure 1:
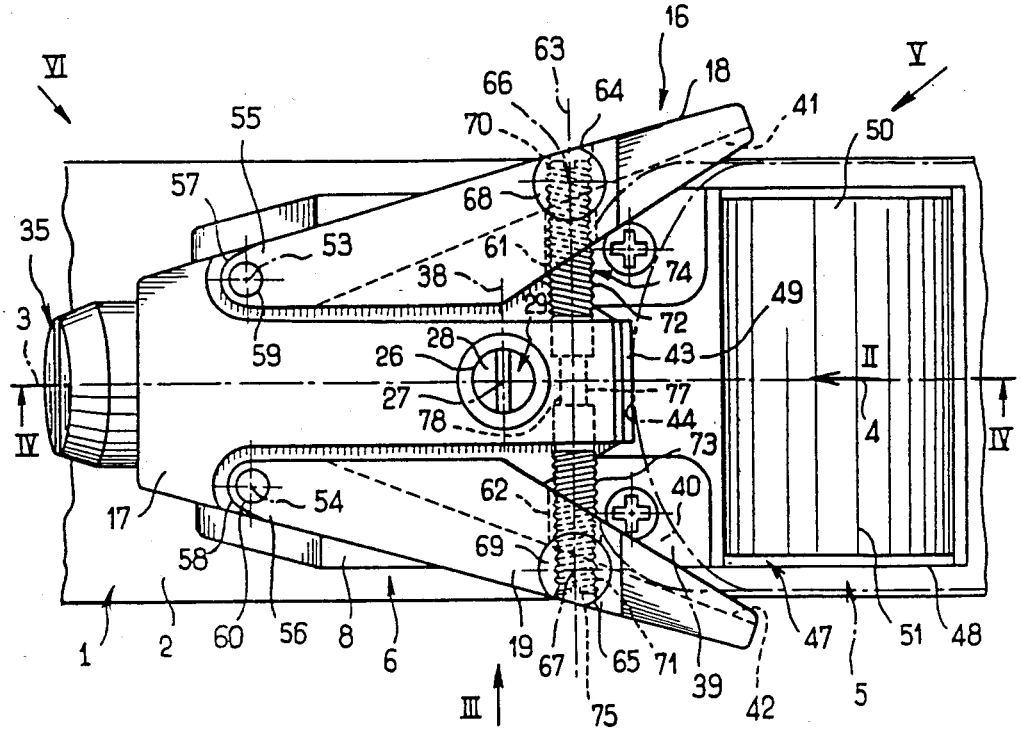
FIG. 1 illustrates a top view of the binding of the present invention in the rest position, i.e., in the absence of any torsional bias or any force directed in a forward direction.

The present invention is fundamentally different from traditional solutions to the problem of the increased friction on the boot during a forward fall. Traditional solutions to this problem rely on a sensor which functions during a forward fall to decrease the 'hardness' of the elastic system which resists lateral pivoting of the jaw.

In contrast to prior art bindings, the present invention transforms the frontward force on the boot that occurs during torsional and frontward fall, into a torque in the direction of the lateral pivoting of the boot against on the lateral wings of the jaw.

To accomplish these goals, the binding of the present invention which is of the "front abutment" type previously described, comprises a support zone, integral with the jaw and positioned between its two wings. This support zone on the jaw supports the front-end zone of the boot at the front thereof with respect to the ski along a force line which extends between the two support lines and intersects a plane passing through both support lines, above their convergence point. As a result, when the boot applies a pivoting moment or torque to one of the wings of the jaw so that the jaw pivots around one of the two support lines, an additional pivoting moment is added by the boot to the jaw as a result of the passing of the boot frontwardly against the support zone.

In a preferred embodiment, means are also provided to adjust the relative positions of the lateral wings and the support zone. However, during lateral pivoting of the jaw with respect to the ski, the position of the lateral wings and the support remained fixed with respect to one another.

It should be noted that the binding of the present invention can be implemented in an extremely simple and reliable manner without the necessity of any sensor or any return mechanism positioned between the sensor and the elastic system. In order to implement the present invention, one can easily modify the binding of French Pat. Nos. 2,517,214; 2,478,476; 2,458,299; 2,419,737; and 2,420,359, and U.S. Pat. Nos. 4,337,965; 4,345,776; 4,405,153; and 4,260,175 the disclosures of which are hereby incorporated by reference, by adding a support zone to the jaw. Such an addition of a support zone, which is integral with the jaw, causes no additional complications, practically no additional cost, and no additional risk of damage to the leg of the skier due to a possible malfunction, inasmuch as the device of the present invention does not rely on any delicate parts which are normally associated wtih a sensor.

The present invention, further provides such a binding in combination with the ski.

Referring to FIG. 1–9, the ski is generally designated by reference to numeral 1. Ski 1 is shown in its normal utilization position in which upper surface 2 of ski 1 is generally planar and horizontal in the description which follows. Ski 1 also has a longitudinal plane of symmetry 3 which is assumed to be substantially vertical. Plane of symmetry 3 corresponds to the plane of crosssection IV—IV in FIG. 1. Arrow II illustrates the reference direction corresponding to the normal direction of displacement of the ski, which is parallel to surface 2 and is positioned along plane 3. This direction of displacement of the ski, which coincides with direction II in FIG. 1, will serve as the reference direction when the terms "frontwardly", "rearwardly", "front," and "rear" appear in the description which follows and plane 3 will serve as a reference when the term "lateral" is used.

Upper surface 2 on ski 1 has a rear binding mounted thereon (not shown) which is adapted to immobilize the rear end of the sole of boot 5 with respect to the ski. Front binding 6, which is shown, is adapted to immobilize to the front portion of boot 5 and the sole of boot 5.

Binding 6 is of the type described in FIGS. 10–12 of French Pat. No. 2,458,299. Binding 6 is mounted on ski 1 by support 7 which is clearly seen in FIGS. 4 and 5. Support 7 is similar to the support element described in French Pat. No. 2,458,299.

Support element 7 is preferably a monoblock formed, for example, by the molding of a metal alloy with a metal base plate 8. Base plate 8 is attached to ski 1, preferably by screws schematically illustrated by axes 9 and 10. As a result, the screws connect support 7 with ski 1 so that support 7 is positioned flat on upper surface 2 of ski 1 and support 7 forms a projection which extends above upper surface 2 of ski 1 in a direction substantially perpendicular to ski 1. Furthermore, support 7 is positioned on ski 1 so that support 7 is symmetrical with respect to the longitudinal plane of symmetry 3 of ski 1.

Figure 4:
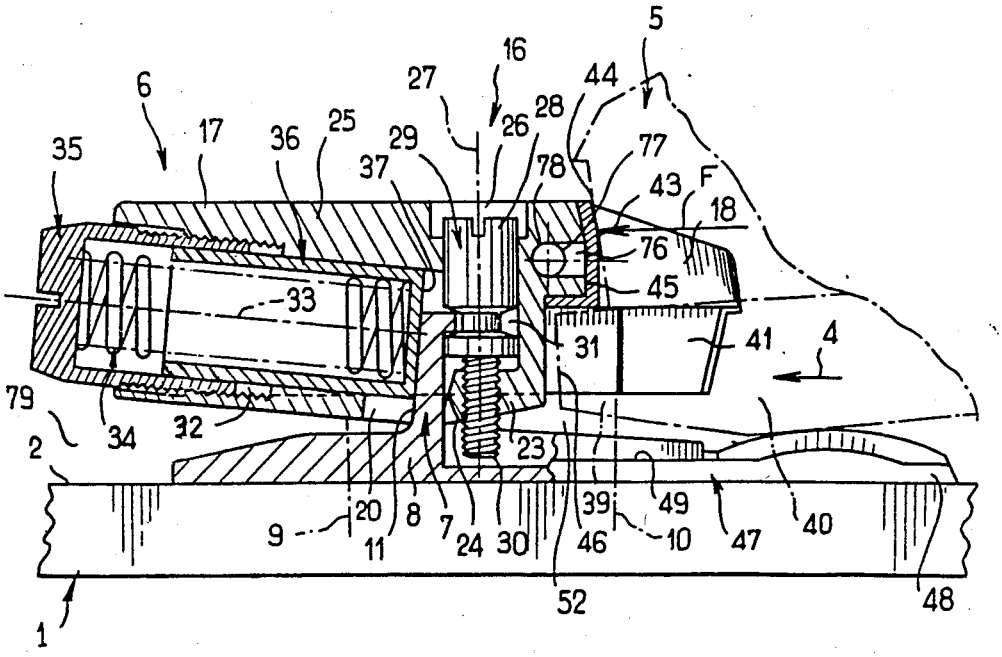
FIG. 4 illustrates a cross sectional view of the binding taken along plane IV—IV of FIG. 1, wherein plane IV—IV defines a longitudinal plane of symmetry for the boot and the binding when the boot is in the rest position.

As is described in French Pat. No. 2,458,299, support 7 comprises a front support surface 11 which is also symmetrical with respect to plane 3 and is substantially perpendicular to surface 2. However, as seen in FIG. 4, surface 11 may be inclined slightly toward the rear. Front surface 11 of support 7 is adapted to contact the elastic energization mechanism which biases binding 6 against lateral pivoting as will be described below.

As seen in FIGS. 5 and 6, support 7 also comprises a base 8 and a rear portion comprising two projections 12 and 13 which are symmetrical with respect to one another and with respect to plane 3. In addition, support 7 further comprises a wing 14 positioned on top of projections 12 and 13. Wing 14 extends toward the rear, and is parallel to base 8. Furthermore, wing 14 comprises a recess 15 therein which is symmetrical with respect to plane 3 and which opens toward the rear.

Support 7 is adapted to be capped, as described in French Pat. No. 2,458,299, by a jaw 16. Jaw 16 is also preferably a monoblock which is formed by the molding of a metal alloy or by the molding of a plastic material. In the embodiment seen in FIGS. 1–9, jaw 16 comprises a body 17 and two lateral wings 18 and 19 supported by body 17. The assembly formed by body 17 and wings 18 and 19 functions as one integral unit during the operation of the binding, and permits the adjustment of these elements with respect to each other as will be discussed below.

Body 17 is in the form of an oblong block, which is oblong in direction 4 and is symmetrical with respect to plane of symmetry 3 when the binding is in a rest position. The binding is in its rest position when there are no external torsional forces acting on the binding. As a result, as seen in FIG. 1, the binding is in its rest position when the longitudinal axis of the binding is substantially parallel to the longitudinal axis of the ski as is seen in FIG. 1.

As is seen in FIGS. 4 and 6, body 17 has an internal opening 20 therein which opens downwardly. Support element 7 is engaged in opening 20.

Grooves 21 and 22 are provided at the bottom of opening 20. Grooves 21 and 22 open toward the front, and are adapted to engage projections 12 and 13, respectively, of support element 7. In the rest position, the grooves 21 and 22 contact projections 12 and 13 simultaneously.

Body 17 also comprises a projection 23, positioned at the bottom of opening 20 and which extends frontwardly between grooves 21 and 22. Projection 23 comprises a tapped bore 24. The longitudinal axis of bore 23 is an axis 27 which is substantially vertical and is positioned in plane 3. In addition, projection 23 does not extend below the lower portion of opening 20.

Projection 23 has sufficient dimensions that when grooves 21 and 22 press frontwardly on projections 12 and 13, respectively, wing 14 is interposed between grooves 21 and 22 and is positioned above projection 23. Because an upper wall 25 of body 17 is spaced above projection 23 at a height greater than the vertical height of wing 14, wing 14 has vertical play betwen projection 23 and upper wall 25. Furthermore, wing 14 is substantially parallel to upper surface 2 of the ski when the binding is in its rest position. In addition, upper wall 25 includes an opening 26 through which axis 27 also passes.

The binding further comprises a screw 29 having a head 28 and a threaded shaft 30. Threaded shaft 30 is adapted to be screwed into tapped opening 24 of projection 23. Opening 26 has a sufficient diameter to permit head 28 of screw 29 to pass therethrough, but does not permit any relative transverse displacement of head 28 with respect to the binding.

As is described in French Pat. No. 2,458,299, head 28 of screw 29 comprises an annular groove 31 positioned between projection 23 and upper wall 25 when the screw 29 is completely screwed into opening 24. Cut-out or recess 15 of wing 14 is adapted to engage groove 31 when binding 16 is mounted on support 7. As a result, head 28 and screw 29 are frontwardly, laterally, upwardly, and downwardly supported with respect to ski 1.

As a result of the above-described structure, the screwing or unscrewing of screw 29 in tapped opening 24 adjusts the vertical position of body 17 with respect to support 7 and therefore, with respect to upper surface 2 of the ski.

The binding also comprises an elastic energization mechanism which biases grooves 21 and 22 against projections 12 and 13, and which further biases groove 31 of screw 29 against cut-out or recess 15 of support 7. This elastic energization mechanism is adapted to be received in tapped opening 32 in body 17. One end of opening 32 opens into opening 20 while the other end of opening 32 opens to the exterior of the front of body 17. Longitudinal axis 33 of opening 32 is positioned in plane 3 and is perpendicular to surface 11 of support 7.

The elastic energization mechanism comprises a compression spring 32 which is positioned within opening 32. The longitudinal axis of spring 34 is aligned with axis 33. The front of spring 34 is supported on a cap 35 which is adapted to be screwed within opening 32 to adjust the tension of spring 34. The rear portion of spring 34 contacts a piston 36 which is slidably mounted along axis 33 and in opening 32. Piston 36 comprises a rear surface 37 which is oriented substantially perpendicular to axis 33 and which is biased under the action of spring 34, on front surface 11 of support element 7.

As a result of the pressure of rear surface 37 on front surface 11 of support 7, the binding in biased against lateral pivoting away from a stable rest position. However, during a fall, a torsional force can be generated which overcomes this bias and laterally pivots the binding away from this rest position against the bias of this elastic system.

As discussed above, jaw 16 also comprises a body 17 and wings 18 and 19. Wings 18 and 19 extend toward the rear with respect to body 17. Furthermore, wings 18 and 19 are symmetrical with respect to plane 3 and with respect to one another when in the rest position. Wing 18 is positioned on the same side of plane 3 as projection 13 and groove 22, and while wing 19 is positioned on the same side of plane 3 as projection 12 and groove 21. As a result, the force exerted on lateral wing 18 so as to displace wing 18 away from plane 3 during a torsional fall, causes a pivoting of jaw 16 around axis YY'. Axis YY' is defined by the cooperation of projection 13 with groove 22, and by the cooperation of groove 31 with recess 15.

Axis YY' is positioned in a plane 38 as is seen in FIG. 6. Plane 38 is perpendicular to plane 3 and is substantially perpendicular to direction 4. Furthermore, plane 38 is oblique with respect to upper surface 2 of the ski.

In an analogous manner, a force exerted on wing 19 so as to displace wing 19 away from plane 3 causes a rotation of jaw 16 around axis XX' as seen in FIG. 6. Axis XX' is defined by the cooperation of projection 12 with groove 21 and the cooperation of groove 31 with cut-out 15. Plane 38 is formed by axes XX' and YY', and therefore, axis XX' is also positioned in plane 38. Furthermore axis XX' is symmetrical with respect to plane 3.

The two axes XX' and YY' converge at a point A which is positioned substantially on axis 27 at a level which corresponds substantially to the median vertical level of groove 31 above the ski.

The pivoting described above is well known in itself and results in the boot being pressed against one or the other of lateral wings 18 and 19, both in conventional bindings, and the binding of the present invention. To assist this lateral pivotingg each lateral wing comprises a shoulder which projects downwardly from each lateral wing. Thus, lateral wing 18 comprises a downwardly projecting shoulder 41 and lateral wing 19 comprises a downwardly projecting shoulder 42. These shoulders also extend toward plane 3, and are positioned to the rear of body 17. The top portion of these shoulders is substantially at the same vertical level as point A.

Shoulder 41 is adapted to engage front-end zone 39 of sole 40 of boot 5 during lateral pivoting of boot 5 against wing 18. Analogously, shoulder 42 is adapted to engage front-end zone 39 of sole 40 of boot 5 during lateral pivoting of the boot against lateral wing 19.

The pivoting of jaw 16 around one of axes XX' and YY' is accompanied by upward displacement of that portion of lateral wings 18 and 19 and of that portion of body 17 that is positioned behind plane 38. As a result of this upward displacement of the lateral wings the liberation of the sole of the boot from shoulders 41 and 42 is facilitated. Furthermore, the pivoting of jaw 16 around one of axes XX' and YY' is also accompanied by the downward displacement of that portion of lateral wings 18 and 19 and body 17 in front of plane 38. The downward displacement of this portion of the jaw can occur because this portion of jaw 16 behind plane 38 is spaced above ski 2 by virtue of play 79 which is reserved for this purpose between this portion of the jaw behind plane 38 and base 8 and/or upper surface 2 of the ski.

During lateral pivoting of the boot and binding there is an increase in the bias that the elastic system provides against lateral pivoting of the jaw. More specifically, the force supplied by surface 37 of piston 36 on surface 11 of support 7 increases as a result of the movement of piston 36 toward cap 35, thereby compressing spring 34.

During a torsional fall that includes the frontward component, the boot experiences an additional resistance to lateral pivoting. This additional resistance to lateral pivoting is the result of the frontward portion of sole 40 of boot 5 being pressed downwardly on upward surface to ski, due to tendency of the boot to pivot upwardly and toward the front of the ski, despite the efforts of the rear binding. In a conventional binding, this increased resistance to lateral pivoting during a frontward and torsional fall may prevent the boot from releasing from the binding, thereby injuring the skier.

According to the present invention, the tendency of the boot to pivot upwardly and frontwardly with respect to the ski during a frontward and torsional fall has been put to beneficial use. In the present invention, pivoting moment of jaw and body around axis XX' (which results from the force of front-end zone 39 of sole 40 on lateral wing 19) or the pivoting moment of the jaw around axis YY' (which results from the boot being applied to lateral wing 18) is increased by an additional pivoting moment or torque exerting itself around the same axis and in the same direction as the lateral pivoting due to the torsional force.

To accomplish this increase in the moment of the jaw, the embodiment illustrated in FIGS. 1–8 comprises a support zone 43 positioned between lateral wings 18 and 19. Zone 43 faces the rear and is symmetrical with respect to plane 3 when the binding is in its rest position. Zone 43 is adapted to serve as a frontward support for the rear front end zone 44 of boot 5. It should be noted that zone 44 is defined in this embodiment by the front-end zone of the upper of boot 5, but it is also within the scope of the invention to position zone 44 on any other portion of the boot, such as on the sole.

Zone 43 is fixed with respect to body 17. Furthermore, zone 43 further comprises a surface 45 having a coating composed of a material having a low coefficient of friction in the zone of contact with the upper boot.

In the example illustrated in FIGS. 1–8, zone 43 is substantially planar and is substantially perpendicular to direction 4. The bottom of zone 43 is preferably substantially at the vertical level of convergence point A. Furthermore, body 17 further comprises a recess 46, positioned beneath zone 43. Recess 46 opens toward the rear and opens downwardly so as to engage front-end zone 39 of sole 40. As the result of this engagement of front-end zone 39 of sole 40 with recess of 46, conntact between front-end zone 44 of the upper of the boot and support zone 43 is guaranteed, as soon as the boot is placed in the binding.

Thus, when a fall occurs which results in a twisting or torsional action on the leg, in combination with a frontward force being exerted on the leg, this frontward force on the leg causes the front-end zone 44 of the boot to exert a force F on support zone 43 as seen in FIG. 7. This force F, is generally oriented substantially in the direction 4, along plane 3. This force F acts along a force line 47 which intersects plane 38 of axes XX', YY' between these two axis and above point A. It should be noted that regardless of the axes (XX' or YY') around which the pivoting of the jaw and body occurs with respect to support 7 due to the torsional component of the fall, the force F applied along force line 47 acts as the directional torque for pivoting the binding in the same direction and around the same axis as the torsional components of the fall.

Figure 8:
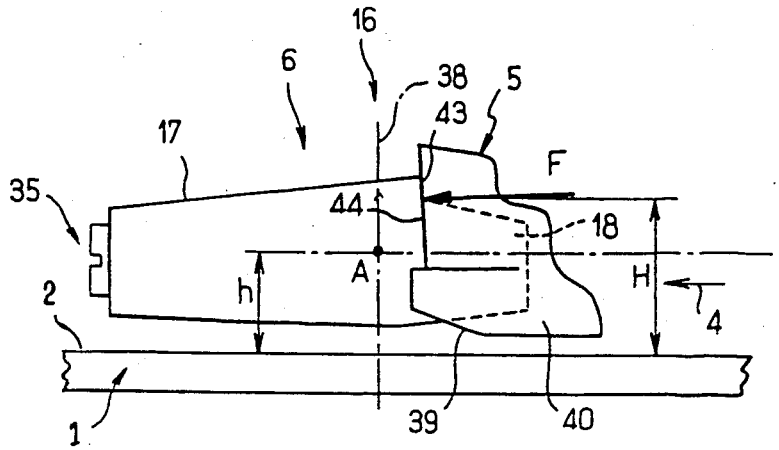
FIG. 8 is a schematic view corresponding approximately to that of FIG. 4, and shows the position of the frontward support zone of the jaw.
Figure 9:
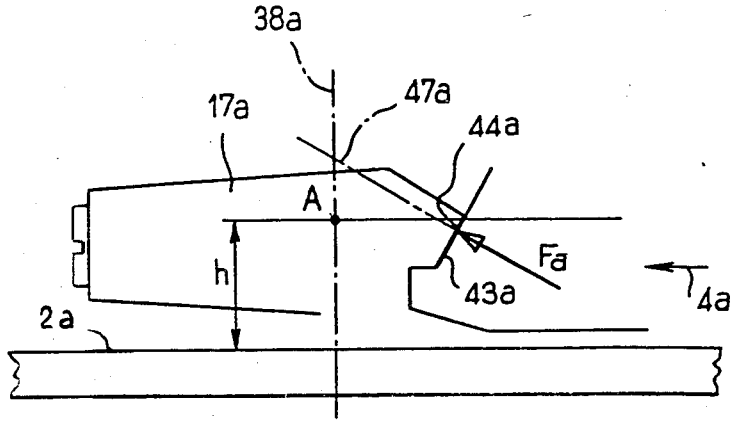
FIG. 9 illustrates a schematic view of an alternative embodiment of the binding of the present invention.

FIGS. 8 and 9 illustrate different embodiments of the present invention, in which the positions of convergence point A and force line 47, and axes XX' and YY' with respect to force line 47 are different. Thus, for example, in FIG. 8, the median vertical level of contact between front-end zone 44 of the upper of the boot and in support zone 43 which is referred to as H, is higher than the vertical height of convergence point A, which is referred to as h.

However, it is also within the scope of the invention to position the median vertical level of mutual contact between front-end zone 44 of the upper and support zone 43 at substantially the same level as convergence A or below A, as seen in FIG. 9. In FIG. 9, **17*a* refers to the body of the binding and 43*a* refers to the support zone; however, the design of this binding is identical in every other respect to the binding described in FIGS. 1–8**.

In this embodiment, support zone **43*a* is substantially perpendicular to the longitudinal plane of symmetry of ski 1. However, in this example, support zone 43*a* is inclined toward the rear with respect to direction 4*a*. As a result, when a torsional fall is accompanied by a frontward fall, front-end zone 44a of the boot, which can for example be on the upper, or on the lower portion of the boot, applies a force to support zone 43a having a component Fa which is perpendicular to the support zone in the longitudinal plane of symmetry of the ski. Force Fa, like force F, acts along force line 47a which intersects plane 38a** (defined by axes XX' and YY') between these axes, above their convergence point A.

In addition, means can be provided for facilitating contact between the front-end zone of the boot and support zone 43 or 43a during a fall, in particular during a frontward fall. This means 47, which is seen in FIGS. 1–4, and which can also be provided in the embodiment of FIG. 9, is positioned forwardly of support zone 43 on upper surface 2 of the ski. Means 47 is a downward support for supporting sole 40 of the boot. Means 47 comprises two portions: a portion for supporting an intermediate portion of sole 40, spaced from the front of the sole, and a portion adapted to support an overhang portion of the sole positioned at the front of the sole and also positioned under support zone 43, immediately rearward thereof.

Means 47 comprises a plate 48 which is integral with upper surface 2 of the ski, and can be integral with base 8 of support element 7. Plate 48 comprises a flat front zone 49 positioned beneath support zone 43 and immediately rearwardly thereof. More specifically, substantially flat front zone 49 extends directly beneath cut-out or recess 46 which receives front-end zone 39 of sole 40. Furthermore, zone 49 extends from this recess 46 to substantially the rear edge of wings 18 and 19.

The second portion of plate 48 is a rear zone 50, which extends upwardly in a convex manner. Rear zone 50 is for example, preferably in the form of a portion of a cylinder revolution around a generatrix 51 perpendicular to plane 3 so as to form a convex upward projection with respect to front zone 49. Furthermore, zone 50 is positioned immediately behind zone 49. As a result under normal conditions, and under conditions other than a fall, zone 50 offers a downward support for sole 40 of boot 5, and specifically for the intermediate portion of sole 40. In addition, the front-end zone 39 of sole 40 is elevated so that it hangs over front zone 49 of the plate seen in FIGS. 3 and 4. Consequently, front-end zone 39 of sole 40 is spaced from the upper surface 2 of ski 1.

During a frontward fall the boot experiences forces which pivot it upwardly and toward the front. This upward and frontward motion of the boot causes a rolling of sole 40 on convex zone 50, and a pivoting of the front-end zone 39 of sole 40 toward zone 49, so as to reduce the play 52 between front-end zone 39 and zone 49. As a result, even if the pivoting movement of the boot is very small, the frontend zone 44 of the boot is applied to support zone 43 much more effectively than would otherwise be the case, due to flat zone 49 and convex zone 50.

Of course, the embodiment which has just been described comprises only a non-limiting embodiment. In particular, it is within the scope of the invention to use any means for mounting body 17 of jaw 16 on support 7. The precise definition of axes XX' and YY', and the precise embodiment of the elastic system may be altered without going beyond the scope of the invention. For example, the means for linking body 17 and support 7 and the elastic system described in French Pat. Nos. 2,517,214; 2,478,476; 2,458,299; 2,419,737; and 2,420,359 belonging to the applicants, can be used in the present invention.

The invention also comprises means for adjusting the position of lateral wings 18 and 19 with respect to each other and with respect to support zone 43 so as to more precisely adapt the binding to the exact configuration and dimension of different boots having front-end zones 44 and 39 of different shapes and sizes.

This adjustment means comprises journal axes 53 and 54, around which jaws 18 and 19 are adapted to respectively rotate. Axes 53 and 54 are positioned substantially parallel to axis 27, and are symmetrical with respect to one another and with respect to plane 3 when the binding is at rest. Also, axes 53 and 54 are positioned on either lateral side of body 17 and of the front-end zone thereof, as seen in FIG. 1.

This adjustment means also comprises a front portion of each lateral wing. More specifically, the front end of lateral wings 18 and 19 respectively, are in the from of caps 55 and 56. Caps 55 and 56 comprise two spacd apart elements, between which is positioned cramps 57 and 58, respectively. Wings 18 and 19 also respectfully comprise pins 59 and 60 for connecting caps 55 and 56 with cramps or legs 57 and 58 respectively. Furthermore, pins 59 and 60 are journal pins through which journal axes 53 and 54 pass, respectively. As a result, wings 18 and 19 pivot around pins 59 and 60 respectively.

In addition, the adjustment apparatus further comprises two openings in the rear portion of each wing 18 and 19, to the rear of opening 20. An alignment axis 63 passes through these two openings in wing 18 and 19. Alignment axis 63 is: substantially perpendicular to plane 3; positioned above shoulders 41 and 42; positioned to the rear of opening 20; positioned above cut-out recess 46; and is positioned immediately in front of surface 45. The first of these openings are openings 61 and 62, which are positioned respectively, in the interior of lateral wings 18 and 19. The second openings are openings 64 and 65 which are also positioned respectively in lateral wings 18 and 19. Openings 64 and 65 are positioned between openings 61 and 62, respectively, and the exterior of lateral wings 18 and 19, respectively. Openings 64 and 65 comprise a cylinder of revolution around axes 66 and 67, respectively. Axes 66 and 67 are substantially perpendicular to alignment axis 63 and substantially parallel to axes 53 and 54. Axes 66 and 67 are also symmetrical with respect to one another and with respect to plane 3 when the binding is in its rest position.

Each of second openings 64 and 65 are adapted to receive journals 68 and 69 respectively, therein. Journals 68 and 69 are adapted to rotate around axes 66 and 67, respectively, within openings 64 and 65, respectively. In addition, openings 64 and 65 are adapted to guide the rotation of journals 68 and 69 therein, respectively. Journals 68 and 69 comprise tapped bores 70 and 71, respectively. Alignment axis 63 is the longitudinal axis of bores 70 and 71 and the longitudinal axes of these bores 70 and 71 is also the longitudinal axes of openings 61 and 62.

Figure 2:
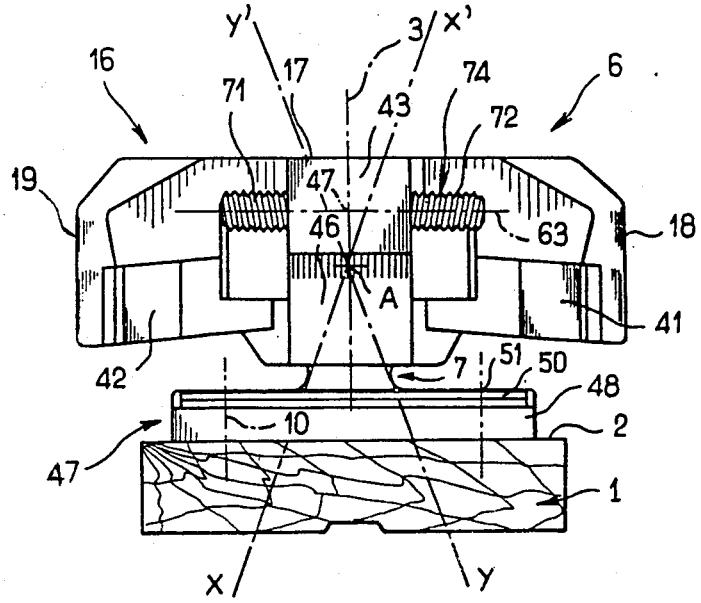
FIG. 2 illustrates a rear view of the binding along arrow II of FIG. 1.
Figure 3:
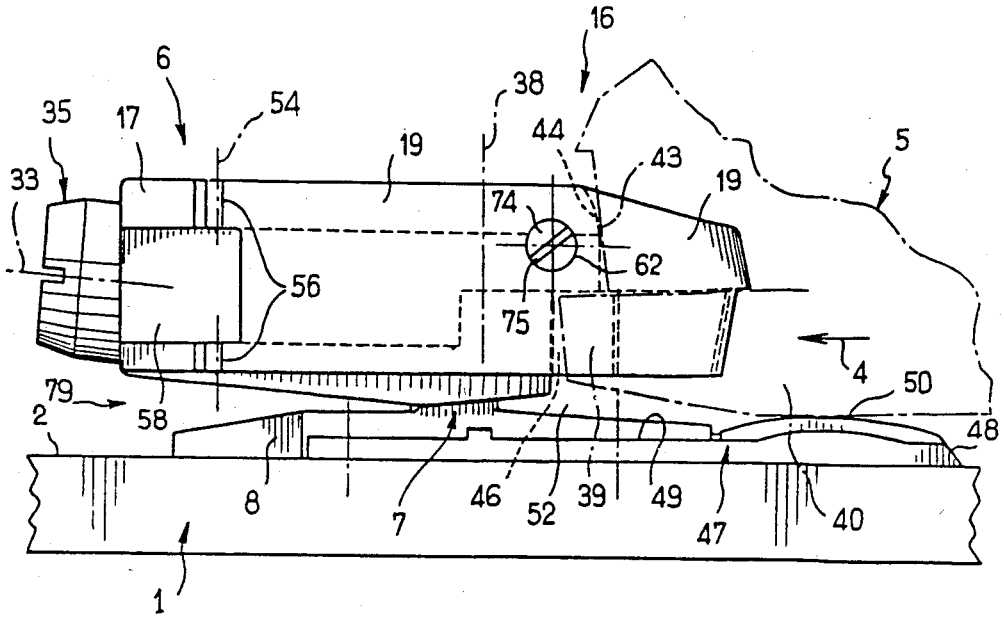
FIG. 3 illustrates a side view of the binding along arrow III of FIG. 1.

Each tapped bore 70 and 71 has inverse threads as may be seen in FIGS. 1 and 2. Tapped bore 70 and 71 are adapted to receive an end zone 72 or 73, respectively, of a pin 74. End zone 72 and 73 of pin 74 are threaded in a complimentary manner to bores 70 and 71 so that each end zone 72 and 73 of pin 74 can be screwed in bores 70 and 71, respectively. When this is done, the longitudinal axis of pin 74 coincides with axis 63. In addition, pin 74 has, at one of its ends, a slot 75 which is adapted to receive a screwdriver. In the embodiment seen in FIG. 1, slot 75 is positioned within journal 69 of wing 19.

As can be seen in FIG. 1, pin 74 is adapted to extend from wing 18, through body 17 to wing 19. As a result, body 17 must comprise an opening to accommodate pin 74. This opening is a slit 76, which traverses body 17 on both sides thereof along axis 63. Furthermore, a central plane which passes through the center of slit 76 includes axis 63 and is substantially perpendicular to axes 53 and 54. In addition, slit 76 opens toward surface 45 where it is closed by support 43 as seen in FIG. 4, to allow engagement of pin 74 for the assembly of the apparatus.

Pin 74 also comprises a peripheral groove 77, around the central portion of pin 74 and positioned at substantially its midlength, in the zone situated within slot 66. The central portion of pin 74 is adapted to engage a recess 78 provided in slot 76 at the intersection of the central portion of pin 74 with plane 3. Furthermore, recess 78 extends symmetrically on both sides of plane 3.

The binding assures the immobilization of pin 74 vis-a-vis body 17 along axis 63 by virtue of the engagement of pin 74 with tapped bores 70 and 71. In addition, the free displacement of pin 74 in the rearward direction through slot 76 is also impossible by virtue of the engagement of pin 74 with journals 68 and 69. However, a slight displacement of pin 74 in slot 76 is possible along the median plane thereof in the forward or rearward direction. Furthermore, pin 74 can be rotated around axis 63 as well with respect to journals 69 and 70. This can be accomplished by introducing a screwdriver into slot 75 to rotate pin 74. The rotation of pin 74 causes lateral wings 18 and 19 to move toward or away from each other, depending upon whether the user rotates the screwdriver in slot 75 in one direction or the other. As a result, the relative positions of shoulders 41 and 42 on the front-end zone 39 of sole 40 and the relative position of shoulders with respect to support 43 and front-end zone 44 of the upper of the boot can be changed while preserving the symmetrical position wings of 18 and 19 with respect to plane 3.

Of course, it is also within the scope of the invention to provide means for preventing spontaneous rotation of pin 74. For example, one can select an appropriate pitch of the threading of pin 74 and of the tapping of the journal 68 and 69 while taking into account the material of which each of these elements is composed, so as to prevent the spontaneous rotation of pin 74. In addition, any other means known to those skilled in the art can be used for this purpose.

The rear end of the boot can be retained on the ski by any type of heel binding. However, the heel binding which is preferable will have arms which are laterally journaled, such as those described in French Pats. Nos. 2,263,796; 2,248,680; 2,258,876; and 1,363,895 which are hereby incorporated by references.

Furthermore, although the invention has been described with reference to particular means materials and embodiments, it is to be understood the invention is not limited to the particulars disclosed and extends to all equivalents within the scope of the claims.

What is claimed is:

1. A ski binding for releasably holding the front of a ski boot on a ski, wherein said front of said boot comprises a front end zone spaced from the lateral edges of said boot, wherein said binding comprises:

(a) a jaw for holding said front of said boot and pivotally mounted to said ski, wherein said jaw laterally pivots in response to pivoting of said boot;

(b) a support on said ski, wherein said support comprises two upwardly converging lines of support, wherein said jaw laterally pivots around either one of said two upwardly converging lines of support; and (c) a support zone means on said jaw, for supporting said front end zone of said boot when said front of said boot is held by said jaw, wherein said upwardly converging lines of support define a common transverse plane with respect to said ski, wherein said upwardly converging lines of support converge at a convergence point above said ski, and wherein said support zone means comprises means for engaging said front end zone of said boot, wherein a line perpendicular to said support zone means and extending from the median of said support zone intersects said front end zone of said boot.

2. The binding defined by claim 1 in combination with a ski.

3. The binding defined by claim 1 wherein said boot has two lateral sides and wherein said jaw further comprises a rear portion and two lateral wings, each lateral wing grips one of said lateral sides of said boot, wherein said wings are positioned at said rear portion of said jaw.

4. The binding defined by claim 3 wherein said support zone means is positioned at said rear portion of said jaw and between said two wings, and wherein each support zone means is integral with said jaw.

5. The binding defined by claim 4 further comprising: an elastic energization mechanism adapted to press said jaw rearwardly against said support, wherein said elastic energization mechanism biases said jaw against lateral pivoting.

6. The binding defined by claim 5 wherein said support comprises a rear portion and wherein said two upwardly converging lines of support are positioned on said rear portion of said support, and wherein said jaw and said support together comprises means for lifting said jaw when said jaw laterally pivots around either one of said two upwardly converging lines of support.

7. The binding defined by claim 6 wherein said jaw experiences a moment in response to lateral pressure from said boot against one of said lateral wings, wherein said support zone means further comprises means for increasing said moment experienced by said jaw in response to forward pressure of said front end zone of said boot on said support zone means during lateral pivoting of said jaw due to said moment.

8. The binding defined by claim 6 wherein said upwardly converging lines of support converge a convergence point, wherein the median level of said support zone means is positioned higher than said convergence point.

9. The binding defined by claim 6 wherein said upwardly converging lines of support converge at a convergence point, wherein the median level of said support zone means is positioned at the same vertical level as said convergence point, and wherein said support zone means is inclined in the rearward direction.

10. The binding defined by claim 6 wherein said upwardly converging lines of support converge at a convergence point, wherein the median level of said support zone means is positioned lower than said convergence point, and said support zone means is inclined in the rearward direction.

11. The binding defined by claim 6 wherein said boot further comprises a sole having a front portion and an intermediate portion adjacent said front portion, wherein said binding further comprises a sole support positioned under said sole and on said ski, wherein said sole support comprises means for supporting said intermediate portion and raising said front portion of said sole above said ski.

12. The binding defined by column 11 wherein means for supporting said intermediate portion and raising said front portion of said sole comprises:

(i) a convex zone positioned under said intermediate portion of said sole; and (ii) a substantially flat zone positioned under said front portion of said sole.

13. The binding defined by claim 12 wherein said sole support is integral with said ski and with said support.

14. The binding defined by claim 13 wherein said jaw further comprises a cut-out portion below said support zone means for receiving said front portion of said sole, wherein said substantially flat zone is positioned under said cut-out portion, and wherein said sole support is positioned beneath said lateral wings of said jaw.

15. The binding defined by claim 6 wherein said boot further comprises an upper and wherein said support zone means is positioned at the same vertical level as said upper of said boot.

16. The binding defined by claim 6 wherein said two upwardly converging support lines are positioned symmetrically with respect to one another and with respect to a longitudinal plane of symmetry of said ski, and wherein said support zone means is symmetrical with respect to said plane of symmetry when said binding is in a rest position in which the longitudinal axis of said jaw is substantially parallel to said plane of symmetry.

17. The binding defined by claim 16 wherein said binding is symmetrical with respect to said plane of symmetry when said jaw is supported by both lines of support on said support simultaneously.

18. The binding defined by claim 6 wherein said jaw further comprises means for adjusting the relative positions of said lateral wings and said support zone means.

19. The binding defined by claim 18 wherein said adjusting means comprises means for rotating each lateral wing around a separate axis which is substantially parallel to the axis around which said jaw laterally pivots, wherein said separate axes are positioned symmetrically with respect to the longitudinal plane of symmetry of said ski.

20. The binding defined by claim 19 wherein said rotating means comprises:

(i) a cap, positioned toward the front of each lateral wing of said jaw, wherein said cap comprises two spaced apart elements;

(ii) a cramp positioned in the space between said two spaced apart elements; and (iii) a journal pin, connecting said two spaced apart elements with said cramp and around which one of said lateral wings is adapted to rotate.

21. The binding defined by claim 19 wherein said jaw further comprises: an opening therein for receiving said support; two shoulders, one on each wing, which contact a portion of said boot when said boot is held by said jaw; and a cut-out portion for receiving a sole of said boot; wherein said rotating means further comprises:

a first opening in each of said wings, wherein the longitudinal axis of said first opening is substantially perpendicular of said plane of symmetry of said ski, wherein said first opening is positioned above said shoulders and said cut-out portion of said jaw, and wherein said first opening is positioned rearward of said opening for said support; and a pin, engaging said first opening, wherein rotation of said pin in said first opening rotates said lateral wings around said journal pin.

22. The binding defined by claim 21, wherein said pin comprises two end portions, wherein said rotating means further comprises:

a second opening, in each of said lateral wings, connected to said first opening, wherein said second opening is positioned between the exterior of said lateral wing and said first opening, wherein each second opening is which receives a different end portion of said pin, wherein the longitudinal axes of said first openings in each lateral wing are aligned with each other, and wherein each second opening comprises a tapped bore and each end portion of said pin comprises a tapped portion complementary to said tapped bore of said second opening, whereby each end portion of said pin is adapted to be screwed into each second opening.

23. The binding defined by claim 22 wherein said jaw further comprises a body, between said lateral wins, wherein said body comprises a transverse slit therein, extending forward and behind the longitudinal axis of said first opening, wherein said slit opens toward said support zone means, wherein said slit comprises a recess extending through and symmetrical with the longitudinal axis of said ski, wherein said pin further comprises a peripheral groove adapted to engage said recess of said slit.

24. The binding defined by claim 23 wherein one end portion of said pin further comprises a slit for receiving a screwdriver for rotate said pin in said first and second openings.

25. The binding defined by claim 24 further comprising means to prevent spontaneous rotation of said pin in said first and second openings.

26. The binding defined by claim 6 wherein said support further comprises:

(i) a base attached to said ski;

(ii) two upwardly converging projections extending above said base and which comprise said two upwardly converging lines of support;

(iii) a front portion; and (iv) a wing positioned on top of said projections and having a recess therein which is symmetrical with respect to said longitudinal plane of symmetry of said ski.

27. The binding defined by claim 26 wherein said jaw further comprises an opening which opens downwardly and in which said support is received, and wherein said jaw forms a cap on top of said support.

28. The binding defined by claim 27 wherein said jaw and said support are monoblocks.

29. The binding defined by claim 27 wherein said jaw further comprises two grooves in said opening which are adapted to receive said projections therein, wherein in a rest position of said jaw each projection simultaneously contacts one of said grooves.

30. The binding defined by claim 29 wherein said jaw further comprises:

a screw; and a projection in the bottom portion of said opening, wherein said projection is positioned between said two grooves, wherein said projection further comprises a substantially vertical tapped opening therein adapted to receive said screw therein, whereby the vertical height of said jaw with respect to said support is varied in response to screwing said screw in said projection of said jaw.

31. The binding defined by claim 30 wherein said jaw further comprises an upper wall, spaced above said projection of said jaw a greater distance than the vertical height of said wing of said support, wherein said upper wall has an opening therein for receiving said screw, wherein said projection of said jaw is of sufficient dimensions such that said wing of said support is positioned between said projection of said jaw and said upper wall when said projections of said support contact said grooves of said jaw.

32. The binding defined by claim 31, wherein said screw comprises a groove therein, positioned between said upper wall and said projection of said jaw when said screw is screwed into said opening of said projection of said jaw, wherein said groove of said screw engages said recess of said wing of said support when said screw is screwed into said opening of said projection of said jaw, whereby said screw is frontwardly and laterally supported.

33. The binding defined by claim 32 wherein said jaw further comprises a tapped opening having a longitudinal axis aligned with the longitudinal axis of said ski when said binding is in a rest position, wherein one end of said tapped opening opens into said opening in said jaw, wherein the other end of said tapped opening opens to the exterior of said jaw at the front thereof, wherein said tapped opening is for receiving said elastic energization mechanism.

34. The binding defined by claim 33 wherein said elastic energization mechanism comprises:

(i) a compression spring;

(ii) an adjusting cap positioned at the front end of said tapped opening and said compression spring and for screwing in said tapped opening to adjust the tension of said compression spring; and (iii) a piston positioned at the rear end of said compression spring and comprising a rear surface, biased against said front surface of said support, whereby said grooves of said jaw are biased against said projections of said support and said groove of said screw is biased against said recess of said wing of said support.

35. The bindind defined by claim 6 further comprising means for ensuring that said front end zone of said boot contacts said support zone means whenever said jaw holds said front of said boot.

36. The binding defined by claim 35 wherein said boot further comprises a sole and wherein said ensuring means comprises a recess on the rear portion of said jaw for engaging said sole of said boot when said jaw holds said boot.

37. The binding defined by claim 6 wherein that portion of said jaw behind a plane formed by the lines of support lifts upwardly in response to lateral pivoting of said jaw around one of said lines of support, and that portion of said jaw in front of said a plane formed by said lines of support is displaced downwardly in response to lateral pivoting of said jaw around one of said lines of support.

38. The binding defined by claim 37 wherein said jaw is configured such that the front portion of said jaw is spaced above said ski when said jaw is in the rest position.

* * * * *